US011021824B2

(12) United States Patent
Lee et al.

(10) Patent No.: US 11,021,824 B2
(45) Date of Patent: Jun. 1, 2021

(54) ACCESSORY USED FOR WASHING MACHINE

(71) Applicants: LG Electronics Inc., Seoul (KR); Industry-Academic Cooperation Foundation, Yonsei University, Seoul (KR)

(72) Inventors: Chunbae Lee, Seoul (KR); Younah Kang, Incheon (KR); Soojin Jun, Seoul (KR); Sangwon Lee, Seoul (KR)

(73) Assignees: LG Electronics Inc., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 120 days.

(21) Appl. No.: 16/091,349

(22) PCT Filed: Apr. 6, 2017

(86) PCT No.: PCT/KR2017/003760

§ 371 (c)(1),
(2) Date: Oct. 4, 2018

(87) PCT Pub. No.: WO2017/176060

PCT Pub. Date: Oct. 12, 2017

(65) Prior Publication Data

US 2019/0136431 A1 May 9, 2019

(30) Foreign Application Priority Data

Apr. 8, 2016 (KR) ..... 10-2016-0043325

(51) Int. Cl.
*D06F 7/04* (2006.01)
*D06F 19/00* (2006.01)
(Continued)

(52) U.S. Cl.
CPC ..... *D06F 19/00* (2013.01); *D06F 7/04* (2013.01); *D06F 33/00* (2013.01); *D06F 34/22* (2020.02);
(Continued)

(58) Field of Classification Search
CPC . D06F 7/04; D06F 19/00; D06F 33/00; D06F 34/22; D06F 37/12; D06F 37/24;
(Continued)

(56) References Cited

U.S. PATENT DOCUMENTS

2003/0227394 A1 12/2003 Rothgeb et al.
2015/0204001 A1* 7/2015 Song ..... D06F 35/002 8/137

FOREIGN PATENT DOCUMENTS

KR 10-1988-0012824 11/1988
KR 10-2000-0021103 4/2000
(Continued)

*Primary Examiner* — Levon J Shahinian
(74) *Attorney, Agent, or Firm* — Fish & Richardson P.C.

(57) ABSTRACT

The present invention relates to an accessory used for a top-loading washing machine having: a cabinet for forming the outer appearance thereof; a drum rotatably provided in the cabinet, and of which the upper surface is opened so as to accommodate objects to be treated; and a laundry inlet provided at the upper surface of the cabinet, and washing machine accessory comprises: a body forming the exterior thereof and having a closed inner space; one or more ultrasonic wave generators provided inside the body; and a control unit formed so as to control the ultrasonic wave generator, wherein the body is formed in a shape in which a cross sectional area thereof is gradually reduced from the bottom toward the top thereof, such that the center of gravity of the body is located at the lower side thereof.

17 Claims, 6 Drawing Sheets

(51) Int. Cl.

| | |
|---|---|
| ***D06F 33/00*** | (2020.01) |
| ***D06F 34/22*** | (2020.01) |
| ***D06F 37/12*** | (2006.01) |
| ***D06F 37/24*** | (2006.01) |
| ***D06F 37/42*** | (2006.01) |
| ***D06F 39/00*** | (2020.01) |

(52) U.S. Cl.
CPC ..... *D06F 37/12* (2013.01); *D06F 37/24* (2013.01); *D06F 37/42* (2013.01); *D06F 39/00* (2013.01)

(58) Field of Classification Search
CPC ..... D06F 37/42; D06F 39/00; D06F 2202/02; D06F 2210/00
USPC ..... 68/13 R, 235
See application file for complete search history.

(56) References Cited

FOREIGN PATENT DOCUMENTS

| | | |
|---|---|---|
| KR | 10-2000-0071828 | 11/2000 |
| KR | 10-2015-0087760 | 7/2015 |

* cited by examiner

ACCESSORY USED FOR WASHING MACHINE

CROSS-REFERENCE TO RELATED APPLICATIONS

This application is a National Stage application under 35 U.S.C. § 371 of International Application No. PCT/KR2017/003760, filed on Apr. 6, 2017, which claims the benefit of Korean Application No. 10-2016-0043325, filed on Apr. 8, 2016. The disclosures of the prior applications are incorporated by reference in their entirety.

TECHNICAL FIELD

The present invention relates to an accessory put into a washer by having an ultrasonic generator and a turbidity sensor, and more particularly, to a washer accessory suitable for raising washing efficiency and rinsing efficiency by ultrasonic waves generated by the ultrasonic generator and recommending a preferable rinsing count to a user based on ringing water's contamination level sensed by a turbidity sensor provided to the accessory.

BACKGROUND ART

Generally, a laundry treating device includes a washer, a drier, a styler and the like. And, the washer may include a drying function.

The washer may be mainly classified into a pulsator washer having a drum stand up in a vertical direction (i.e., a laundry entrance is disposed on a top side of a cabinet) or a drum washer having a drum lie in a horizontal direction (i.e., a laundry entrance is disposed on a front side of a cabinet).

Such a washer can be driven through manipulation of a manipulating unit provided to a cabinet of the washer after inputting treatment targets, detergent and the like to the laundry treating device.

A driving cycle of a washer can be mainly classified into a washing cycle, a rinsing cycle and a dewatering cycle.

In the washing cycle, a desired course is selected from a plurality of courses and an appropriate amount of detergent can be then inputted. And, the rinsing cycle can be performed at least once depending on a contamination level of a treatment target (i.e., laundry).

Meanwhile, detergent contains surfactant. In the washing cycle, contaminants attached to a wash target can be removed through a process for the surfactant to be attached to and detached from the laundry.

In doing so, if the process for the surfactant to be attached to and detached from the laundry is accelerated, wash efficiency can be increased. Hence, ongoing efforts are made to study the wash efficiency increase. For example, if ultrasonic vibration is applied to a washing water in the washing cycle, the process for the surfactant to be attached to and detached from the laundry can be accelerated.

Moreover, in the rinsing cycle, although a user can adjust the count of the rinsing cycle, it is difficult for the user to determine how many rinsing cycles are necessary to remove detergent and contaminants remaining in the laundry after the washing cycle.

Namely, if the count of the rinsing cycles is too small, the detergent and contaminants remaining in the laundry cannot be removed completely. On the contrary, if the count of the rinsing cycles is too big, a consumption amount of a rinsing water increases.

Therefore, many ongoing efforts are made to research and develop a process for increasing a washing efficiency and a rinsing efficiency by vibrating a washing or rinsing water within a drum in a washing cycle and a washer accessory capable of recommending a preferable count of rinsing cycles.

DISCLOSURE OF THE INVENTION

Technical Task

One technical task of the present invention is to provide a washer accessory capable of increasing a washing efficiency and a rinsing efficiency by applying ultrasonic waves to at least one of a washing water and a rinsing water through a ultrasonic generator.

Another technical task of the present invention is to provide a washer accessory capable to recommending, to a user, whether a prescribed rinsing count is preferable (i.e., a preferable rinsing count) by detecting a contamination level (or turbidity) of a rinsing water.

Further technical task of the present invention is to provide a washer accessory easily applicable to a related art washer.

Technical Solutions

In one technical aspect of the present invention, provided herein is a washer accessory used for a washer of a top loading type including a cabinet, a drum rotatably installed within the cabinet, the drum having an open top side to receive a treatment target therein, and a laundry entrance provided to a top side of the cabinet, the washer accessory including a body forming an exterior by having a sealed internal space, at least one ultrasonic generator provided inside the body, and a control unit configured to control the at least one ultrasonic generator, wherein the body is formed in a manner that a weight center of the body is located at a lower side.

For example, the body may be formed in a manner that a cross-sectional area gradually decreases toward a top side from a bottom side.

Here, the ultrasonic generator may be preferably provided to a lower part within the body.

Moreover, the washer accessory may further include a turbidity sensor configured to sense a turbidity of a washing or rinsing water received within the drum and a third communication module configured to communicate with at least one of a first communication module provided to the washer and a second communication module provided to an external terminal.

And, data sensed by the turbidity sensor may be transmitted to at least one of the first communication module and the second communication module through the third communication module.

Moreover, the turbidity sensor may be disposed inside the body, a sensing window may be formed at a location corresponding to the turbidity sensor in the body, and the sensing window may be formed of a transparent material.

Moreover, a weight of the body may be preferably determined so that at least one portion of the body is submerged in a washing or rinsing water at a height equal to or greater than a height of the turbidity sensor in the body.

Moreover, the turbidity sensor may be preferably disposed above the ultrasonic generator.

Moreover, the data sensed by the turbidity sensor may be transmitted to the at least one of the first communication module and the second communication module through the third communication module when a washing cycle and a rinsing cycle end.

The washer accessory may further include a memory storing information of an additional rinsing count corresponding to the turbidity of the washing or rinsing water in form of a table. And, the information of the additional rinsing count corresponding to the data may be transmitted to the at least one of the first communication module and the second communication module through the third communication module together with the data sensed by the turbidity sensor.

Moreover, when the data sensed by the turbidity sensor and the information of the additional rinsing count are transmitted to the at least one of the first communication module and the second communication module, a stop signal for stopping the washer for a preset time may be transmitted together.

Moreover, the third communication module may receive information of an additional rinsing count actually performed in the washer from one of the first communication module and the second communication module.

Here, if the control unit determines that an additional rinsing count transmitted from the third communication module is different from the actually performed additional rinsing count, a turbidity of a rinsing water in a last rinsing cycle and information of an additional rinsing count corresponding to the turbidity may be transmitted to the at least one of the first communication module and the second communication module through the third communication module.

Moreover, the turbidity of the rinsing water in the last rinsing cycle and the information of the additional rinsing count corresponding to the turbidity may be transmitted to the at least one of the first communication module and the second communication module, a stop signal for stopping the washer for a preset time is transmitted together.

Moreover, a plurality of the ultrasonic generators may be disposed on a bottom side of the body along a circumferential direction of the body by being spaced apart from each other with a preset spacing.

Moreover, the turbidity sensor may be located at a radial-direction center portion of the body and a pair of the sensing windows may be provided to oppose each other at a height corresponding to the turbidity sensor.

Moreover, at least one weight for adjusting total weight of the accessory may be detachably provided inside of the body.

Advantageous Effects

According to the present invention, it is able to provide a washer accessory capable of increasing a washing efficiency and a rinsing efficiency by applying ultrasonic waves to at least one of a washing water and a rinsing water through a ultrasonic generator.

According to the present invention, it is able to provide a washer accessory capable to recommending, to a user, a preferable rinsing count by detecting a contamination level (or turbidity) of a rinsing water.

According to the present invention, it is able to provide a washer accessory easily applicable to a related art washer.

BEST MODE FOR INVENTION

Reference will now be made in detail to the preferred embodiments of the present invention, examples of which are illustrated in the accompanying drawings. A washer described in the following conceptually includes a top loading washer and a front loading washer. An accessory according to an embodiment of the present invention may be applicable to both a top loading washer and a front loading washer, and more preferably, to the top loading washer.

Meanwhile, since a damping structure, a water supply structure, a drain structure and the like, which can be provided within a washer, are identical or similar to those of a related art washer, details of general structures of the related art washer shall be omitted from the description of the present invention.

Figure 1:
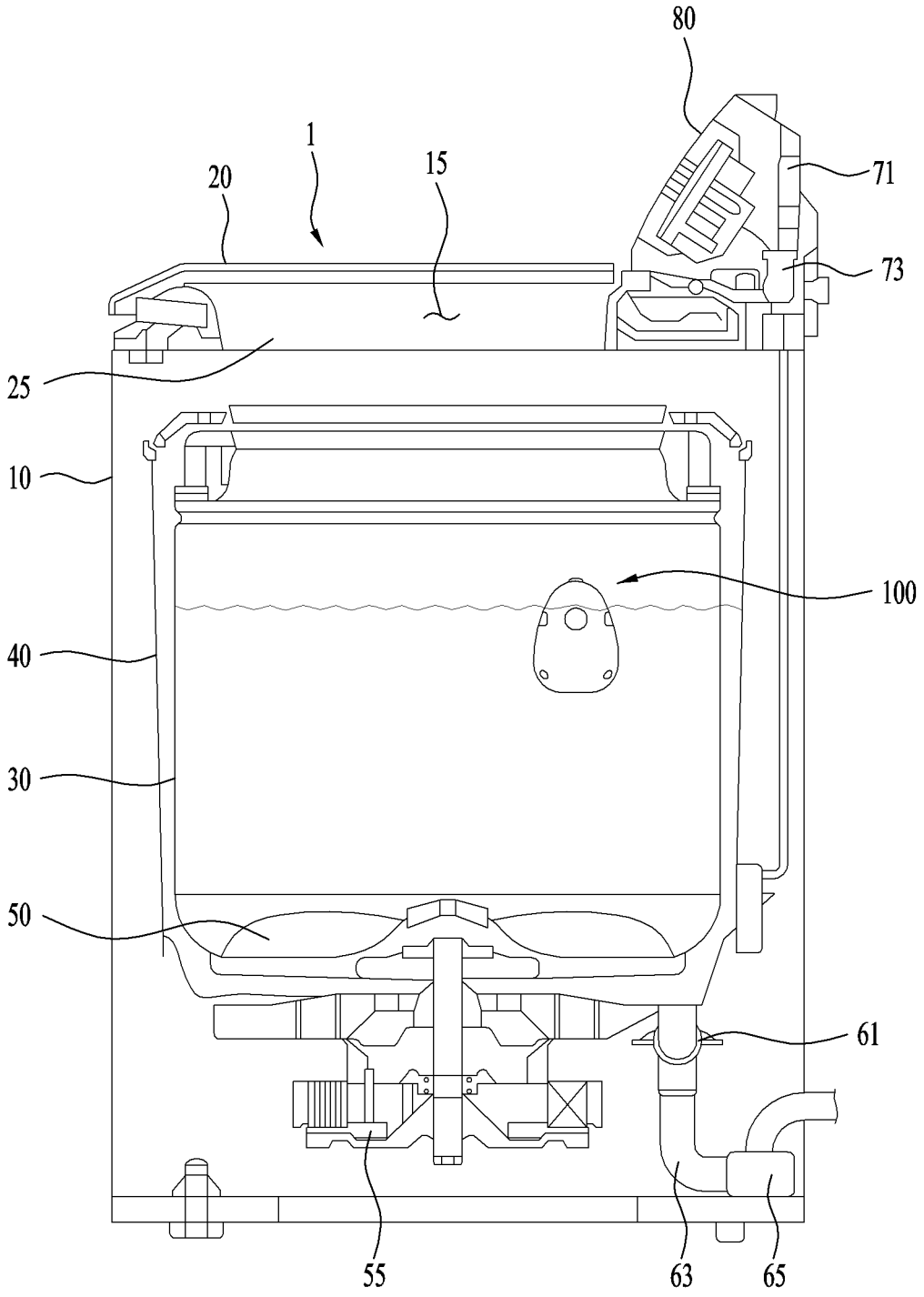
FIG. 1 is a diagram showing a washer accessory provided within a washer according to an embodiment of the present invention.

FIG. 1 is a diagram showing a washer accessory provided within a washer according to an embodiment of the present invention.

For clarity of the following description, a washer to which an accessory is applied may be limited to a top loading washer. The reason for this is to enable the accessory to operate in a manner of floating on a washing or rinsing water received in the washer.

Referring to FIG. 1, a washer 1 may have a configuration of a top loading type including a cabinet 10 forming an exterior, a drum 30 provided within the cabinet 10, and a laundry entrance provided to a top side of the cabinet 10.

Moreover, the washer 1 may further include a tub 40 configured to receive a washing water therein by being disposed to enclose lateral and bottom sides of the drum 30 within the cabinet 10, a pulsator 50 configured to provide a turning force to the washing water in the drum 30, and a drive unit 55 rotating the pulsator 50.

The drum 30 is rotatably provided within the cabinet 10, and may be provided with a turning force by the drive unit 55.

The entrance 15 can be open/closed by a door 20, and a top cover 25 may be further provided between the door 20 and the entrance 15. A laundry target can be put into the drum 30 through the entrance 15 while the door 20 and the top cover 25 are open.

The door 20 and the top cover 25 may be disposed on the top side of the cabinet 100 located to oppose the entrance 15.

By the drive unit 55, the drum 30 and the pulsator 50 can be rotated simultaneously or either the drum 30 or the pulsator 50 can be rotated. By the drive unit 55, the drum 30 and the pulsator 50 can be rotated in the same direction or rotated in opposite directions, respectively.

In order to enable the drum 30 and the pulsator 50 to be rotated in the same direction or opposite directions by a single drive unit 555, a non-illustrated structure such as a clutch may be applicable among the drive unit 55, the drum 30 and the pulsator 50.

The washer 1 may include a drain valve 61 for discharging a washing or rinsing water in the tub 40, a drain passage 63 and a drain pump 65.

By driving the drain pump 65 and the drain valve 61, the washing or rinsing water in the tub 40 can be externally discharged through the drain passage 63.

The washer 1 may include a water supply passage and a water supply valve 73. Water supplied from an external hydrant can be supplied into the tub 40 through the water supply passage 71 by driving the water supply valve 73.

In doing so, the water supply passage 71 may be configured to pass through a detergent box not shown in the drawing. In a water supplying process, a detergent in the detergent box can be supplied into the tub 40 together with water.

The washer 1 may include a first communication module (not shown) for communication with at least one of an accessory and an external terminal described later and a first display unit 80 for manipulating the washer 1 and displaying information.

In some implementations, in the drum 30 of the washer 1, an accessory 100 configured to sense turbidity (or contamination level) of at least one of the washing water and the rinsing water and generate ultrasonic waves can be received.

Such an accessory is described in detail with reference to other drawings as follows.

Figure 2:
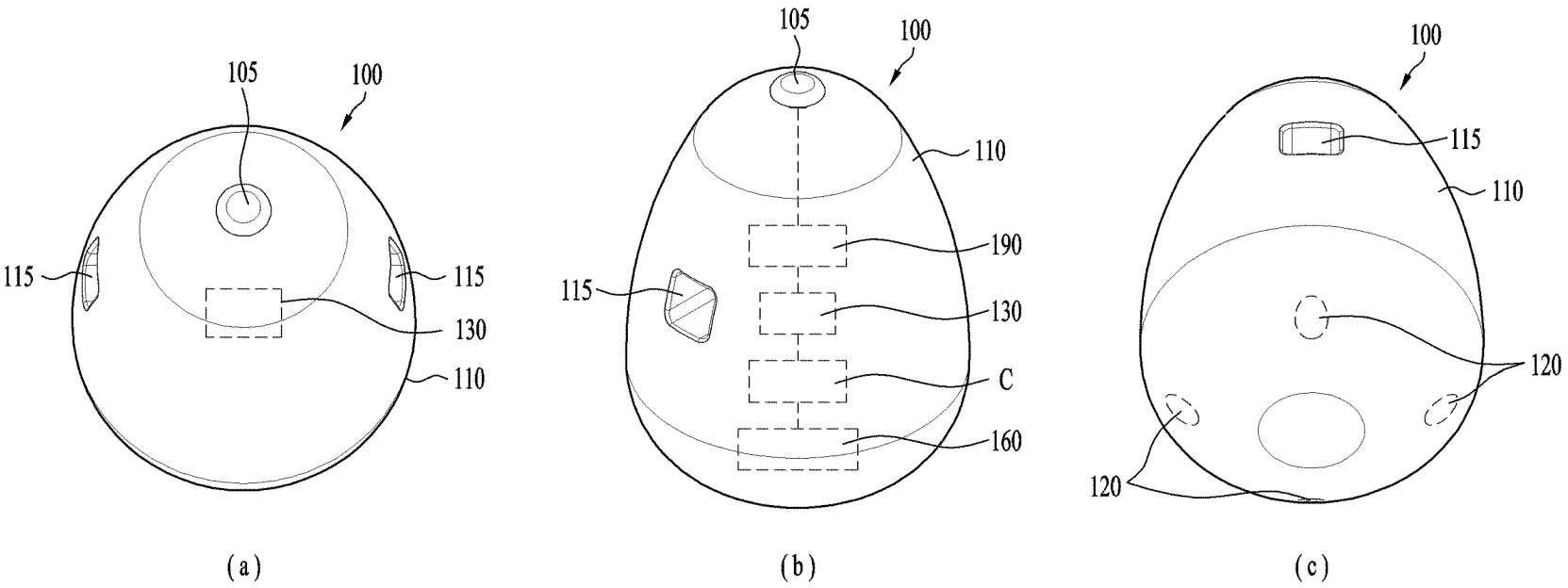
FIGS. 2 (*a*) to 2 (*c*) are perspective diagrams of a washer accessory provided within a washer according to an embodiment of the present invention.

FIGS. 2 (*a*) to 2 (*c*) are perspective diagrams of a washer accessory provided within a washer according to an embodiment of the present invention. In particular, FIG. 2 (*a*) is a top-view perspective diagram of an accessory, FIG. 2 (*b*) is a lateral-view perspective diagram of the accessory, and FIG. 2 (*c*) is a bottom-view perspective diagram of the accessory.

An accessory described in the following is applicable to all washers of a top loading type such as the aforementioned washer 1. Here, the washer of the top loading type may mean a washer including a tub having an open top, a drum having an open top, and a rotatable shaft vertically provided to an installation surface so as to rotate the drum.

First of all, referring to FIGS. 2 (*a*) to 2 (*c*), a washer accessory 100 according to an embodiment of the present invention may include a body 110 forming an exterior, at least one ultrasonic generator 120 provided inside the body 110, and a control unit C controlling the ultrasonic generator 120. And, a weight center of the body 110 may be positioned in a lower side.

For example, the body 110 may be formed in a manner that a cross-sectional area gradually decreases toward a top side from a bottom side. Moreover, a weight center of the body 110 may be positioned in a lower center portion of the body 110.

Figure 3:
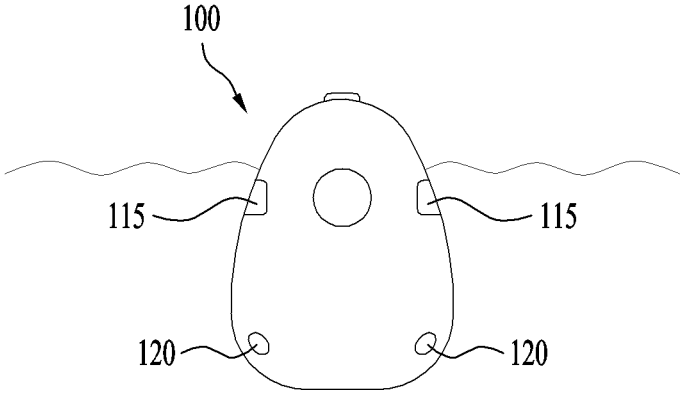
FIG. 3 is a conceptual diagram showing that an accessory according to an embodiment of the present invention floats on a washing or rinsing water in a washer.

Hence, in a state that a washing or rinsing water is supplied within the washer 1, the accessory 100 may float in a standing state (as shown in FIG. 3).

Moreover, at least one weight (not shown) may be provided to a lower side within the body 110.

The weight may be detachably provided inside the body 110 so as to adjust total weight of the accessory 100. Preferably, the weight is detachably provided to a lower center portion within the body 110.

Since the body 110 of the accessory 100 is formed airtight, an air layer is formed within the body 110, whereby the accessory 100 can float on the washing or rinsing water. In doing so, in order for a portion of the accessory 100 to sink in the washing or rinsing water so as to enable a turbidity sensor (described later) to submerge in the washing or rinsing water, a weight of the accessory 100 can be set or adjusted.

The ultrasonic generator 120 can be controlled by the control unit C so as to generate ultrasonic waves toward a washing/rinsing water in a washing/rinsing cycle.

Preferably, the ultrasonic generator 120 is provided to a lower part within the body 110.

This is to effectively generate ultrasonic waves toward the washing/rinsing water from the ultrasonic generator 120 in case that the body 110 in the standing state floats in the washing/rinsing water.

The ultrasonic waves generated from the ultrasonic generator 120 can vibrate the washing/rinsing water through the body 110. As the action of surfactant attached to and detached from a wash target is accelerated by the vibration of the washing/rinsing water, washing/rinsing efficiency can be raised.

Preferably, a plurality of the ultrasonic generators 120 can be provided to a lower side within the body 110 in a manner of being spaced apart from each other by a preset space along a circumferential direction of the body 110 [cf. FIG. 2 (*c*)].

In some implementations, the washer accessory 100 according to the embodiment of the present invention may further include a turbidity sensor 130 configured to sense a turbidity (or contamination level) of a rinsing water received within the drum 30.

The turbidity sensor 130 is disposed inside the body 110, and a sensing window 115 may be formed at a location corresponding to the turbidity sensor 130 in the body 110. Here, the sensing window 115 may be formed of a transparent material.

The sensing window 115 and the body may be sealed using a sealing member not shown in the drawing.

Thus, the turbidity sensor 130 can sense a turbidity or contamination level of a washing/rinsing water through the sensing window 115.

In order to enable at least one portion of the body 110 to be submerged in a washing/rinsing water over a height at which the turbidity sensor 130 is disposed in the body 130, a weight of the body 110 can be determined. Here, the weight of the body 110 may be set through a selective use of the aforementioned weight or a material change of the body.

Namely, only if the accessory floats on the rinsing water while the turbidity sensor 130 is submerged in the rinsing water at least, the turbidity or contamination level of the rinsing water can be sensed through the turbidity sensor 130 and the sensing window 115.

Moreover, referring to FIG. 3, since the turbidity sensor 130 senses turbidity not in a depth direction of the rinsing water but in a radial direction thereof while submerging in the rinsing water, accuracy of the turbidity detection for the rinsing water can be improved.

Particularly, the turbidity sensor 130 can be located at a radial center portion of the body 110. Here, a pair of the sensing windows 115 may be disposed so as to oppose each other at the height corresponding to the turbidity sensor 130. Hence, the turbidity sensor 130 can be configured to sense turbidity of the rinsing water through at least one of a pair of the sensing windows 115.

Moreover, the turbidity sensor 130 may be disposed above the ultrasonic generator 120. The reason for this is to promote enhancement of the washing/rinsing efficiency through generation of downward ultrasonic waves from the ultrasonic generator 120 and raise the aforementioned sensing accuracy of the turbidity sensor 130.

For example, if the turbidity sensor 130 is configured to sense turbidity of the rinsing water toward a downward direction of the accessory 100, accurate turbidity may not be sensed due to the depth of the washing/rinsing water. (Namely, the turbidity of the rinsing water may be sensed relatively higher than actual turbidity.)

On the contrary, if the turbidity sensor 130 is disposed to sense turbidity of the rinsing water toward a lateral side of the accessory 100, since the width of the tub is smaller than the depth (i.e., height) of the tub, it becomes possible to sense a relatively accurate turbidity of the rinsing water (cf. FIG. 3).

The washer accessory 100 according to the embodiment of the present invention may further include a power input unit 105 provided to a top end of the body 110 and a battery 160 supplying power to the accessory 100.

The power input unit 105 may be configured in form of a push button. If the power input unit 105 is pressed, power may be supplied to the accessory 100 or the power supplied to the accessory 100 may be cut off.

The battery 160 may be configured to be chargeable. Here, the battery 160 may be configured to be charged by a wireless charging system known to the public in general.

In some implementations, the accessory 100 may further include a third communication module configured to communicate with at least one of a first communication module provided to a washer described later and a second communication module provided to an external terminal.

Hereinafter, with reference to another drawing, a configuration in which a washer accessory 100 according to an embodiment of the present invention communicates with a washer and an external terminal is described in detail.

Figure 4:
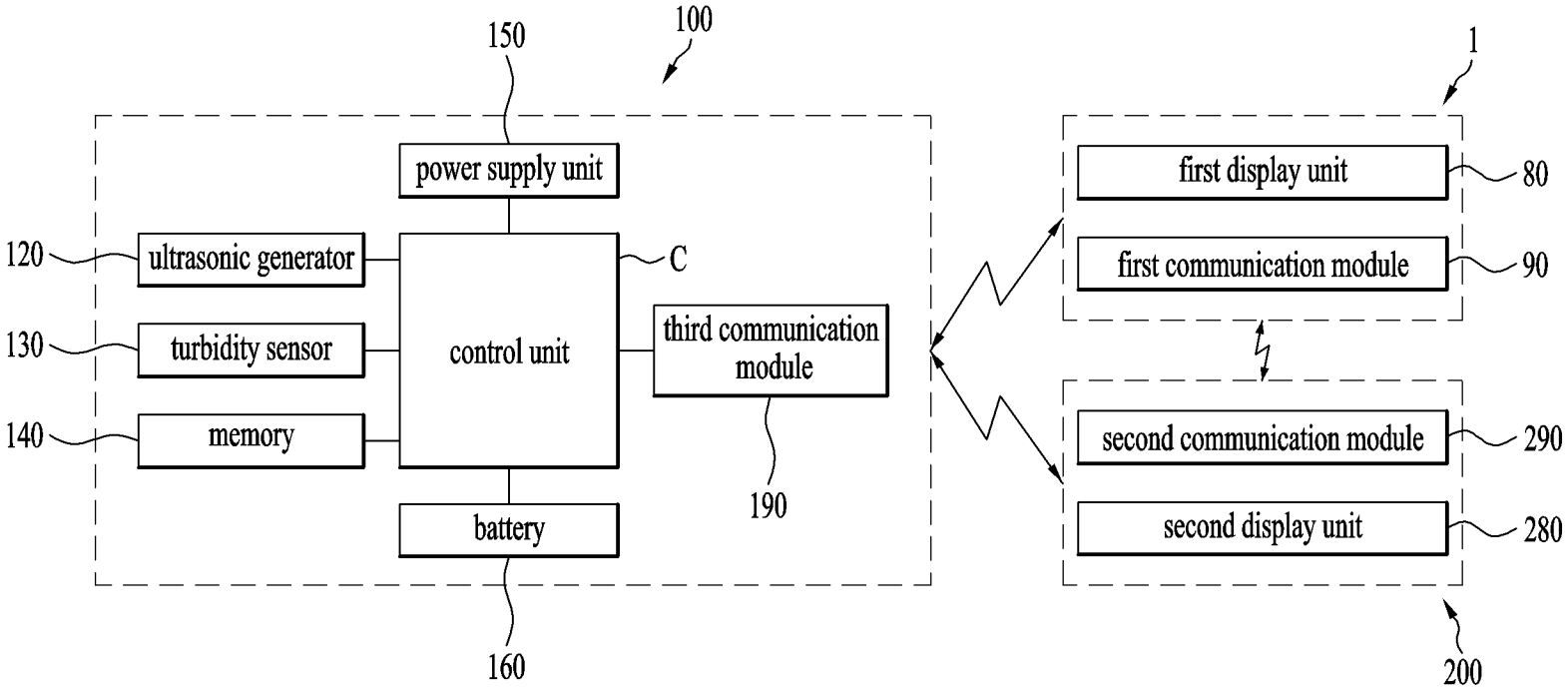
FIG. 4 is a block diagram showing connection relationship of major components of a washer accessory according to an embodiment of the present invention, a washer and an external terminal.

FIG. 4 is a block diagram showing connection relationship of major components of a washer accessory according to an embodiment of the present invention, a washer and an external terminal.

Referring to FIG. 4, a washer accessory 100 according to an embodiment of the present invention may include an ultrasonic generator 120 and a turbidity sensor 130, which are controlled a the control unit C.

The control unit C can control the ultrasonic generator 120 to be activated during one of a washing cycle and a rinsing cycle.

Moreover, if the power input unit 105 shown in FIG. 2 is activated, the accessory 100 may be supplied with power of a battery 160 through a power supply unit 150.

The accessory 100 may be configured to communicate with at least one of a washer 1 and an external terminal 200.

Particularly, the washer 1 includes a first communication module 90, the external terminal 200 includes a second communication module 290, and the accessory 100 may include a third communication module 190 configured to communicate with at least one of the first communication module 90 and the second communication module 290.

Moreover, the first communication module 90 and the second communication module 290 may be configured to communicate with each other.

For example, the first communication module 90, the second communication module 290 and the third communication module 190 may be configured to communicate with each other by Wi-Fi communication, RFID communication or the like.

Particularly, data sensed by the turbidity sensor 130 provided to the accessory 100 may be transmitted to at least one of the first communication module 90 and the second communication module 290 through the third communication module 190.

For example, if the data sensed by the turbidity sensor 130 is transmitted to the first communication module 90 through the third communication module 190, information based on the data can be displayed on a first display unit 80 provided to the washer 1.

On the other hand, if the data sensed by the turbidity sensor 130 is transmitted to the second communication module 290 through the third communication module 190, information based on the data can be displayed on a second display unit 280 provided to the external terminal 200.

Therefore, a user can obtain turbidity of a rinsing water and information on a preferable count rinsing count. Here, each of the first and second display units 80 may include a touch-imputable touch panel.

Particularly, the data sensed by the turbidity sensor 130 can be transmitted to at least one of the first communication module 90 and the second communication module 290 through the third communication module 190 when washing and rinsing cycles of the washer 1 end.

For example, when the washing and rinsing cycles of the washer 1 end, before a dewatering cycle is entered the data sensed by the turbidity sensor 130 can be transmitted to at least one of the first communication module 90 and the second communication module 290 through the third communication module 190.

When the washing and rinsing cycles of the washer 1 end, the third communication module 190 is assumed as receiving a signal for the end from at least one of the first communication module 90 and the second communication module 290.

Moreover, if the dewatering cycle proceeds, an alarm for taking the accessory 100 out of the washer may be displayed on at least one of the first display unit 80 of the washer 1 and the second display unit 280 of the external terminal 200.

Namely, if the accessory 100 is received in the drum of the washer 1 during the dewatering cycle, the accessory 100 may be damaged by the rotation of the drum.

Meanwhile, when the washing and rinsing cycles end, a preferable additional rinsing count can be determined by the control unit C based on the turbidity of the rinsing water.

For example, the accessory 100 may further include a memory 140 configured to store information on an additional rinsing count corresponding to turbidity of a rinsing water in form of a table (i.e., a correspondence table).

And, the information on the additional rinsing count corresponding to the data can be transmitted to at least one of the first communication module 90 and the second communication module 290 through the third communication module 190 together with the data sensed by the turbidity sensor 130.

Namely, the data sensed by the turbidity sensor 130 and the information on the additional rinsing count corresponding to the data can be transmitted to at least one of the first communication module 90 and the second communication module 290 through the third communication module 190 at a timing of at least one of an end of the washing cycle of the washer 1 and an end of a first rinsing cycle (i.e., 1-time rinsing cycle).

Moreover, the data and information transmitted to the first communication module 90 and the second communication module 290 from the third communication module 190 can be displayed on the first display unit 80 of the washer 1 and the second display unit 280 of the external terminal 200.

Therefore, through the information displayed at least one of the first display unit 80 and the second display unit 280, a user can obtain the turbidity of the rinsing water and the information on the preferable additional rinsing count.

In some implementations, when the data sensed by the turbidity sensor 130 and the information on the additional rinsing count are transmitted to at least one of the first communication module 90 and the second communication module 290, a stop signal for stopping the washer 1 for a preset time may be transmitted as well.

Namely, if the data sensed previously by the turbidity sensor 130 and the information on the additional rinsing count are transmitted to at least one of the first communication module 90 and the second communication module 290, a user can obtain the information on the preferable rinsing count (or a preferable additional rinsing count) through the first display unit 80 of the washer 1 and the second display unit 280 of the external terminal 200.

In doing so, a user can set up an additional rinsing count through the first display unit 80 or the second display unit 280. And, it is necessary to stop driving the washer 1 during a time for user's information check and additional rinsing count setup.

Therefore, when the washing cycle ends or the rinsing cycle ends once, the data sensed by the turbidity sensor 130, the information on the additional rinsing count and the stop signal for stopping the washer 1 for the preset time can be transmitted to at least one of the first communication module 90 and the second communication module 290 together.

In this case, the stop signal may be displayed on at least one of the first display unit 80 and the second display unit 280. Simultaneously, the operation of the washer 1 may be stopped for the preset time.

Meanwhile, after checking the information displayed on the first display unit 80 or the second display unit 280, the user can set up a rinsing count or an additional rinsing count.

In doing so, the user can set and execute a rinsing count different from a preferable rinsing count recommended through at least one of the first display unit 80 and the second display unit 280.

For example, the third communication module 190 can receive information on a rinsing count actually executed in the washer 1 from one of the first communication module 90 and the second communication module 290.

In doing so, if the control unit C determines that the rinsing count (i.e., a preferable recommended rinsing count) transmitted from the third communication module 190 is different from the actually executed rinsing count, a turbidity of a rinsing water in a last rinsing cycle and information on an additional rinsing count corresponding to the turbidity can be transmitted to at least one of the first communication module 90 and the second communication module 290 through the third communication module 190.

Preferably, if the control unit C determines that the rinsing count (i.e., a preferable recommended rinsing count) transmitted from the third communication module 190 is greater than the actually executed rinsing count, a turbidity of a rinsing water in a last rinsing cycle and information on an additional rinsing count corresponding to the turbidity can be transmitted to at least one of the first communication module 90 and the second communication module 290 through the third communication module 190.

And, the turbidity of the rinsing water and the information on the additional rinsing count corresponding to the turbidity can be displayed on at least one of the first display unit 80 of the washer 1 and the second display unit 280 of the external terminal 200.

Moreover, the user may determine whether to additionally progress a rinsing cycle through one of the first display unit 80 and the second display unit 280 and set up an additional rinsing count again.

Namely, since a count of actually performed rinsing cycles is smaller than a recommended rinsing count based on the turbidity of a rinsing water, rinsing efficiency may be lowered. Hence, it is necessary to inform the user of relevant information.

Furthermore, if the control unit C determines that the rinsing count (i.e., a preferable recommended rinsing count) transmitted from the third communication module 190 is different from the actually executed rinsing count, a stop signal for stopping the washer 1 for a preset time can be transmitted to at least one of the first communication module 90 and the second communication module 290 through the third communication module 190.

Namely, when a turbidity of a rinsing water in a last rinsing cycle and information on an additional rinsing count corresponding to the turbidity are delivered to at least one of the first communication module 90 and the second communication module 290, a stop signal for stopping the washer 1 for a preset time can be transmitted to at least one of the first communication module 90 and the second communication module 290 through the third communication module 190.

For example, if the control unit C determines that the rinsing count (i.e., a preferable recommended rinsing count) transmitted from the third communication module 190 is smaller than the actually executed rinsing count, a turbidity of a rinsing water in a last rinsing cycle, information on an additional rinsing count corresponding to the turbidity and the stop signal can be transmitted to at least one of the first communication module 90 and the second communication module 290 through the third communication module 190.

The reason for this is to enable a user to determine necessity for additional rinsing and set up an additional rinsing count, based on the information obtained through at least one of the first display unit 80 and the second display unit 280.

As described above, data sensed by the turbidity sensor 130 and information on a preferable additional rinsing count can be displayed on at least one of the first display unit 80 and the second display unit 280.

For clarity of understanding, an embodiment of displaying data sensed by the turbidity sensor 130 and information on a preferable additional rinsing count on the second display unit 280 of the external terminal 200 is described with reference to other drawings as follows.

Figure 5:
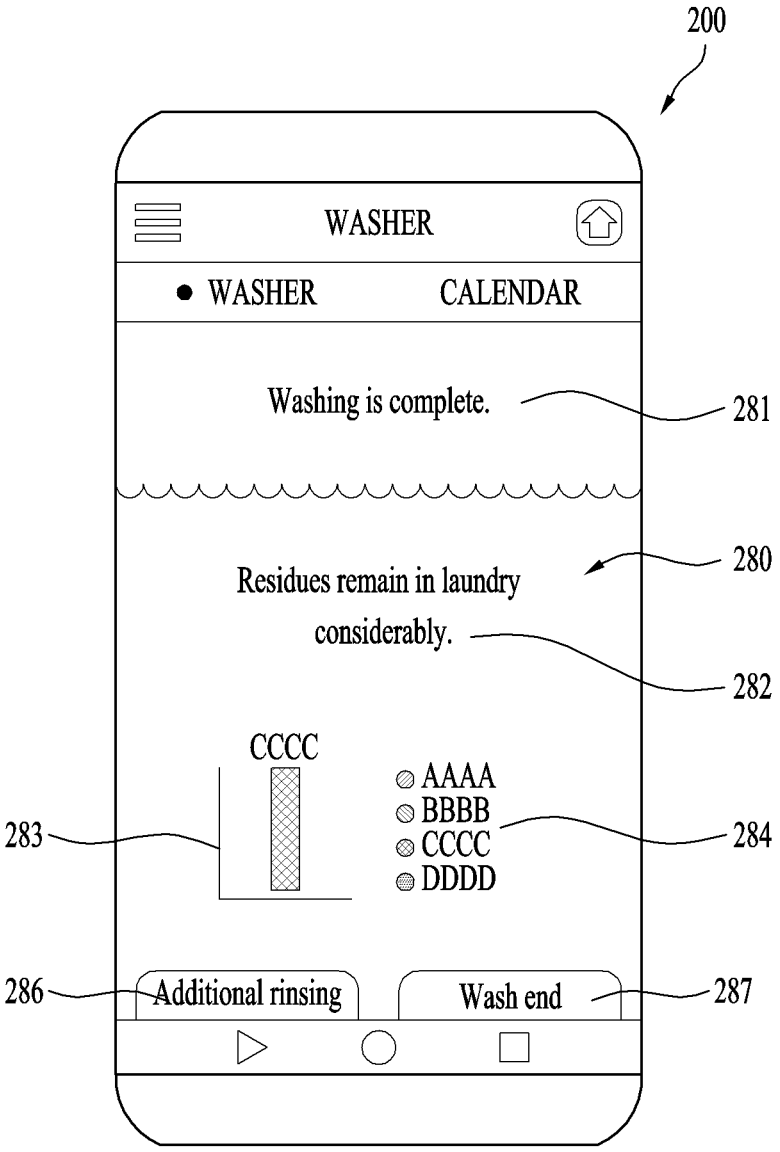
FIG. 5 and FIG. 6 are diagrams showing a display unit of an external terminal communicating with at least one of a washer and an accessory.
Figure 6:
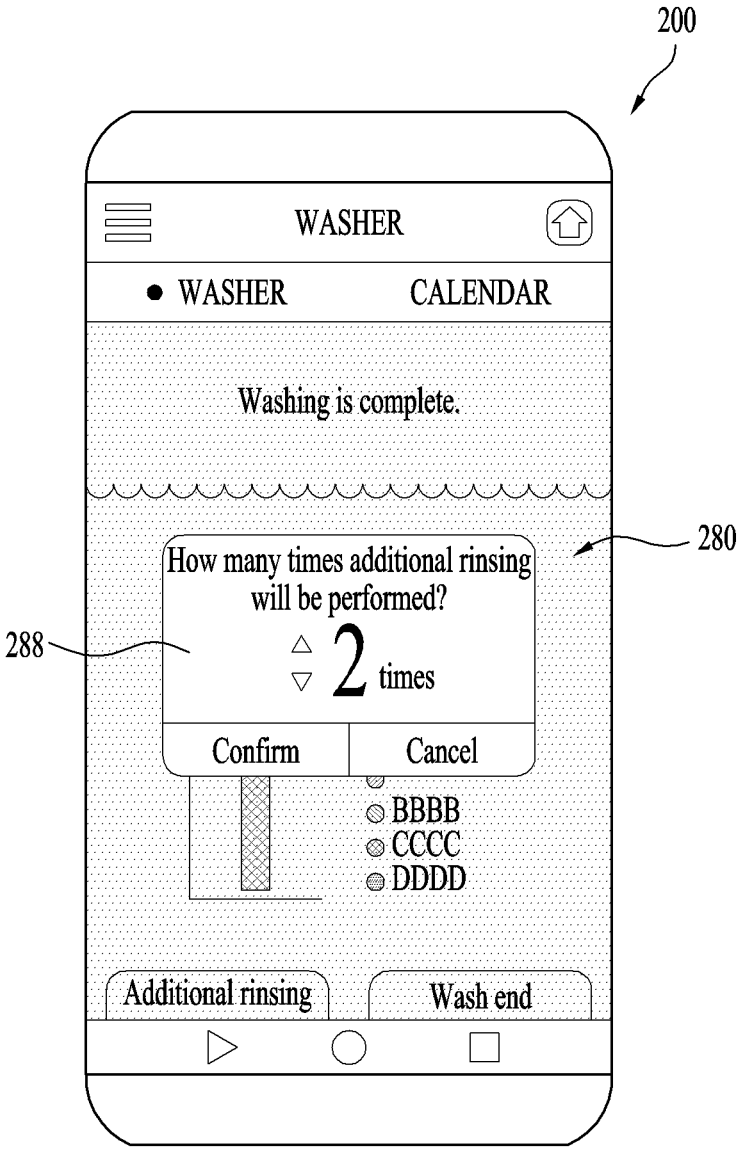

FIG. 5 and FIG. 6 are diagrams showing a display unit of an external terminal communicating with at least one of a washer and an accessory.

A user inputs a wash target to a washer and may then put the aforementioned accessory 100 into a drum of the washer.

In case of a general washer, since a drum is possibly rotated to check a laundry amount before water supply, it is preferable that the accessory 100 is put into the drum after rotation of the drum for checking the laundry amount. Namely, the accessory 100 is preferably put into the washer as soon as water is supplied or after completion of water supply.

Moreover, before the accessory 100 is put into the drum, the user can input a power through the power input unit 105 provided to the accessory 100.

In doing so, whether the third communication module 190 provided to the accessory 100 is normally communicating with a second communication module 280 of an external terminal 200 can be displayed on a display unit 280 of the external terminal 200.

If both a washing cycle and a rinsing cycle are completed, the external terminal 200 may receive information relevant to a turbidity of a rinsing water (i.e., a turbidity of a rinsing water in a last rinsing cycle) and information relevant to an additional rinsing count based on the turbidity from the accessory 100.

For example, referring to FIG. 5, on the second display unit 280 of the external terminal 200, text information 281 on a wash completion and text information 282 on a turbidity of a rinsing water in a last cycle can be displayed.

Moreover, graph information 283 on the turbidity of the rinsing water may be displayed on the display unit 280 in form of a bar graph and description (e.g., turbidity level information) of a level 284 for a turbidity may be displayed next to the graph information 283.

Furthermore, an input unit related to 'additional rinsing 286' and 'wash end 287' may be displayed on the display unit 280 so as to be selected through a user's touch.

In this case, by referring to the aforementioned information, the user can determine whether to perform an additional rinsing or end a wash.

For example, if the user selects 'additional rinsing', a screen of the second display unit 280 may be switched to the screen shown in FIG. 6.

Referring to FIG. 6, a preferable additional rinsing count 288 is displayed on the second display unit 280. And, the displayed additional rinsing count may be incremented/decremented or cancelled in response to user's selection.

In doing so, the preferable additional rinsing count 288 may be displayed as a popup window on the screen shown in FIG. 5.

Thus, the user can check the information on the turbidity of the rinsing water and the information on the preferable additional rinsing count, which are transmitted from the accessory 100 put into the washer 1, through the external terminal 200.

Moreover, based on the information checked through the external terminal 200, the user can easily determine whether to perform an additional rinsing and set up an additional rinsing count.

What is claimed is:

1. A washer accessory used for a washer of a top loading type including a cabinet, a drum rotatably installed within the cabinet, the drum having an open top side to receive a treatment target therein, and a laundry entrance provided to a top side of the cabinet, the washer accessory comprising:

a body forming an exterior by having a sealed internal space;

at least one ultrasonic generator provided inside the body;

a turbidity sensor configured to sense a turbidity of a washing or rinsing water received within the drum;

a third communication module configured to communicate with at least one of a first communication module provided to the washer or a second communication module provided to an external terminal; and a control unit configured to control the at least one ultrasonic generator, wherein the body is formed in a manner that a weight center of the body is located at a lower side, wherein the at least one ultrasonic generator is provided to a lower part within the body, and wherein data sensed by the turbidity sensor is transmitted to at least one of the first communication module or the second communication module through the third communication module.

2. The washer accessory of claim 1, wherein the body is formed in a manner that a cross-sectional area gradually decreases toward a top side from a bottom side.

3. The washer accessory of claim 1, wherein the turbidity sensor is disposed inside the body, wherein a sensing window is formed at a location corresponding to the turbidity sensor in the body, and wherein the sensing window is formed of a transparent material.

4. The washer accessory of claim 3, wherein a weight of the body is determined so that at least one portion of the body is submerged in a washing or rinsing water at a height equal to or greater than a height of the turbidity sensor in the body.

5. The washer accessory of claim 4, wherein the turbidity sensor is disposed above the at least one ultrasonic generator.

6. The washer accessory of claim 4, wherein at least one weight for adjusting a total weight of the washer accessory is detachably provided inside of the body.

7. The washer accessory of claim 3, wherein the turbidity sensor is located at a radial-direction center portion of the body, and wherein a pair of sensing windows are provided to oppose each other at a height corresponding to the turbidity sensor.

8. The washer accessory of claim 1, wherein the data sensed by the turbidity sensor is transmitted to the at least one of the first communication module and the second communication module through the third communication module when a washing cycle and a rinsing cycle end.

9. The washer accessory of claim 8, further comprising a memory storing information of an additional rinsing count corresponding to the turbidity of the washing or rinsing water in form of a table, wherein the information of the additional rinsing count corresponding to the data is transmitted to the at least one of the first communication module and the second communication module through the third communication module together with the data sensed by the turbidity sensor.

10. The washer accessory of claim 9, wherein when the data sensed by the turbidity sensor and the information of the additional rinsing count are transmitted to the at least one of the first communication module and the second communication module, a stop signal for stopping the washer for a preset time is transmitted together.

11. The washer accessory of claim 9, wherein the third communication module receives information of an additional rinsing count actually performed in the washer from one of the first communication module and the second communication module and wherein if the control unit determines that an additional rinsing count transmitted from the third communication module is different from the actually performed additional rinsing count, a turbidity of a rinsing water in a last rinsing cycle and information of an additional rinsing count corresponding to the turbidity are transmitted to the at least one of the first communication module and the second communication module through the third communication module.

12. The washer accessory of claim 11, wherein the turbidity of the rinsing water in the last rinsing cycle and the information of the additional rinsing count corresponding to the turbidity are transmitted to the at least one of the first communication module and the second communication module, a stop signal for stopping the washer for a preset time is transmitted together.

13. The washer accessory of claim 1, wherein the at least one ultrasonic generator comprises a plurality of ultrasonic generators that are disposed on a bottom side of the body along a circumferential direction of the body and that are spaced apart from each other with a preset spacing.

14. A washer accessory, comprising:

a body having a sealed internal space;

a plurality of ultrasonic generators provided inside the body;

a turbidity sensor configured to sense a turbidity of a washing or rinsing water received within a drum of a washer;

a third communication module configured to communicate with at least one of a first communication module provided to the washer or a second communication module provided to an external terminal; and a control unit configured to control the ultrasonic generators, wherein the body is formed in a manner that a cross-sectional area gradually decreases toward a top side from a bottom side, wherein the body is formed in a manner that a weight center of the body is located at a lower side, and wherein data sensed by the turbidity sensor is transmitted to at least one of the first communication module or the second communication module through the third communication module.

15. The washer accessory of claim 14, wherein the data sensed by the turbidity sensor is transmitted to the at least one of the first communication module and the second communication module through the third communication module when a washing cycle and a rinsing cycle end.

16. The washer accessory of claim 15, further comprising a memory storing information of an additional rinsing count corresponding to the turbidity of the washing or rinsing water in form of a table, wherein the information of the additional rinsing count corresponding to the data is transmitted to the at least one of the first communication module and the second communication module through the third communication module together with the data sensed by the turbidity sensor.

17. The washer accessory of claim 16, wherein the third communication module receives information of an additional rinsing count actually performed in the washer from one of the first communication module and the second communication module and wherein if the control unit determines that an additional rinsing count transmitted from the third communication module is different from the actually performed additional rinsing count, a turbidity of a rinsing water in a last rinsing cycle and information of an additional rinsing count corresponding to the turbidity are transmitted to the at least one of the first communication module and the second communication module through the third communication module.

* * * * *